US007614138B2

(12) United States Patent
Asici et al.

(10) Patent No.: US 7,614,138 B2
(45) Date of Patent: Nov. 10, 2009

(54) DEVICE FOR WRAPPING A GALOSH AROUND A FOOTWEAR

(76) Inventors: Yasar Bozkurt Asici, Fevzi Cakmak-2 Sok. No. 38/16, Kizilay, Ankara (TR) 06440; Necati Okyay, Fevzi Cakmak-2 Sok.No.38/16, Kizilay, Ankara (TR) 06440

( * ) Notice: Subject to any disclaimer, the term of this patent is extended or adjusted under 35 U.S.C. 154(b) by 1191 days.

(21) Appl. No.: 10/488,115

(22) PCT Filed: Aug. 28, 2002

(86) PCT No.: PCT/TR02/00048

§ 371 (c)(1),
(2), (4) Date: Feb. 27, 2004

(87) PCT Pub. No.: WO03/017796

PCT Pub. Date: Mar. 6, 2003

(65) Prior Publication Data

US 2004/0244337 A1 Dec. 9, 2004

(30) Foreign Application Priority Data

Aug. 29, 2001 (TR) ..... A 2001 02469
Aug. 27, 2002 (TR) ..... A 2002 02068

(51) Int. Cl.
*B23P 19/00* (2006.01)
*A43B 3/16* (2006.01)
*A43D 11/00* (2006.01)

(52) U.S. Cl. ..... 29/700; 29/424; 29/428; 29/447; 36/7.1 R; 12/1 R

(58) Field of Classification Search ..... 29/424, 29/428, 447, 700, 819; 36/7.1 R, 7.3; 12/1 R, 12/146 C; 219/215
See application file for complete search history.

(56) References Cited

U.S. PATENT DOCUMENTS 3,419,929 A * 1/1969 Snow et al. ..... 12/142 R
3,528,870 A * 9/1970 Paulsen ..... 156/295
3,689,735 A * 9/1972 McLeod et al. ..... 219/215
3,694,939 A * 10/1972 Chen ..... 36/7.3
3,775,793 A * 12/1973 Casavant et al. ..... 12/1 R
2002/0020031 A1* 2/2002 Gultekin et al. ..... 12/1 R

FOREIGN PATENT DOCUMENTS

FR 2610568 A1 * 8/1988
FR 2627151 A1 * 8/1989

* cited by examiner

*Primary Examiner*—Jermie E Cozart
(74) *Attorney, Agent, or Firm*—Venable, Campillo, Logan and Meaney PC

(57) ABSTRACT

The method according to the present invention and the device (1) used to implement the method for wrapping or enveloping a galosh which is also named as an overshoe, around a footwear, have been developed in order to avoid the bacteria, microbes, dust, mud and other dirt particles that may be found on the soles of the footwear, from being carried into and the areas with hygienic requirements. With the device (1), the sole and the side walls (side vamps) of the footwear are wrapped with a film (21) by a method, wherein warm air is blown at a suitable flow rate towards the sole and side vamps of the footwear, which causes the film (21) to shrink and cover the solve and side vamps of the footwear by wrapping them up when it comes into contact with the film.

27 Claims, 5 Drawing Sheets

DEVICE FOR WRAPPING A GALOSH AROUND A FOOTWEAR

The present invention relates to a machine (device) designed to wrap a galosh automatically around a footwear.

In the state of art, the raw material of the galosh is a polyethylene film. Said film formed as a layer, is cut in particular dimensions, then it is sewn manually in the form of a galosh.

The galosh formed in this manner, is slipped over the shoe by using the hands. However in such environments as hospitals and similar premises where hygienic conditions should be provided, since the galosh taken by using a hand, is slipped over the shoe again by using a hand, the contact of the user's hand with the sole of the shoe cannot be avoided. Furthermore, particularly the elderly people, patients, pregnant women and over-weighted people are not able to slip over the galosh over their footwear without the help of another person.

In the Turkish Patent Application No. TR 2000 2030, as a document of the state of art, a unit to provide the galosh material is used and the rubber is adhered onto the edges (sides) of the galosh material by means of an adhesive. Said galosh in this case, is, produced by automatically bringing it to a galosh form, by using a machine which comprises, the binding drums (applicators) enabling the binding of the folded edges, longitudinal cutting drums (cutters) to cut the galosh material longitudinally, a folding apparatus to fold it along its centerline, hot binding and perforating drums to provide the binding and perforation of the galosh, turnstiles to perform horizontal folding and a packaging unit to pack the folded galosh.

The object of the present invention is to provide a method wherein the film material fed from the spool is taken as a layer in advance and then the galosh is slipped over all kinds of footwear without being subjected to any treatment.

Another object of the present invention is to provide a machine by means of which the film material fed from the spool is taken as a layer in advance and then the galosh is slipped over all kinds of footwear without being subjected to any treatment.

Yet another object of the present invention is to provide the shrinkage of said film by reducing the width and length dimensions at a desired ratio.

A final object of the present invention is to provide the protection of the footwear, particularly of the sole region.

The machine for wrapping a galosh around a footwear realized in order to attain the above objects of the present invention has been illustrated in the attached drawings, wherein.

Figure 1:
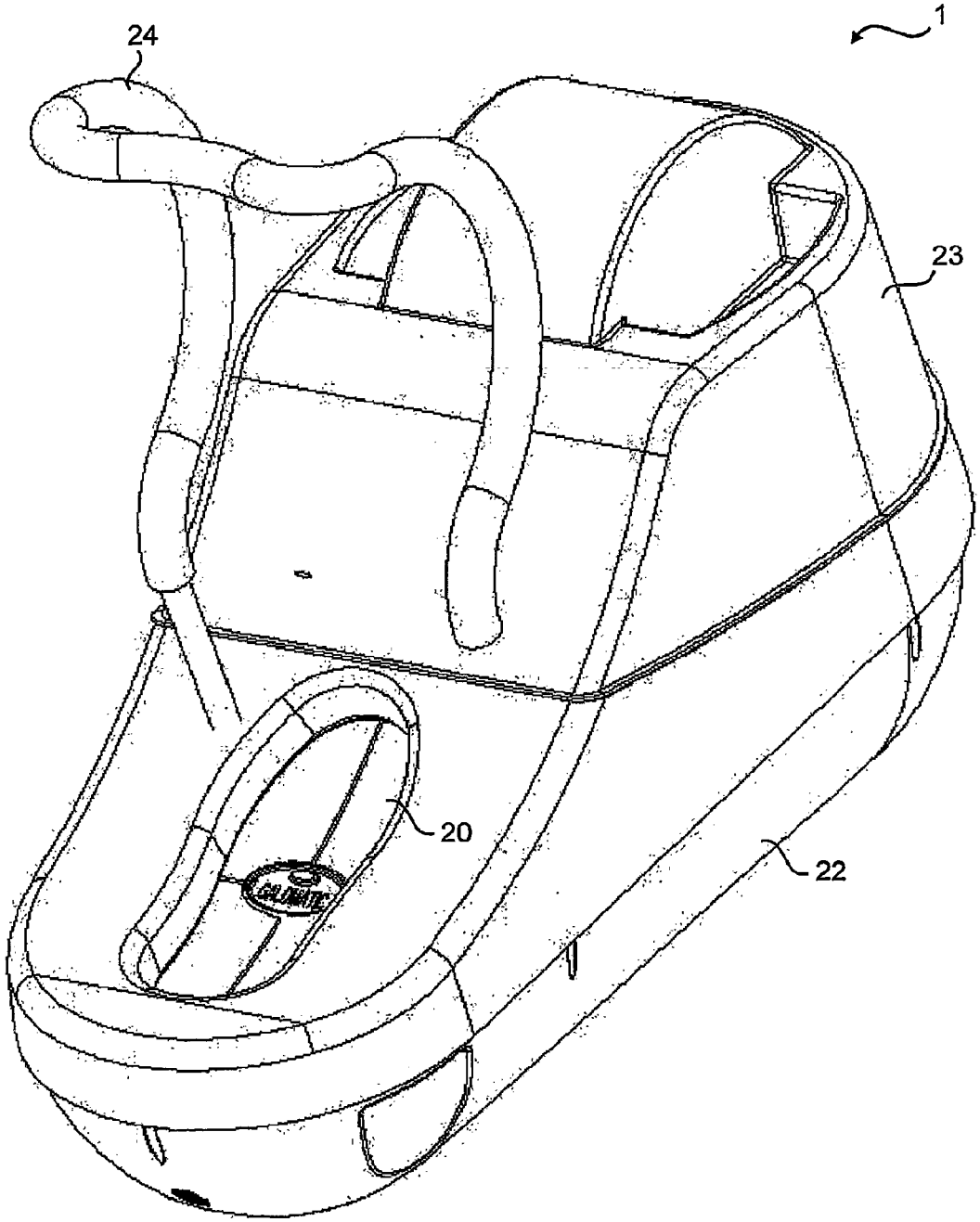
FIG. 1, is the general perspective view of the machine for wrapping a galosh around a footwear.

The components shown in these figures have been enumerated separately as listed below:

1. Galosh wrapper machine
2. Spool recess
3. Driver unit

4. Driver motor
5. Pallet, paddle
6. Shaft
7. Cutting unit
8. Cutting motor
9. Cutter
10. Stretcher (spanner) unit
11. Cylinder
12. Air blower unit
13. Motor
14. Air tunnel
15. Air heater unit
16. Heater
17. Temperature controller
18. Air compression unit
19. Channel
20. Foot platform
21. Film
22. Lower shell
23. Upper shell
24. Handle.

The method for wrapping a galosh around a footwear, and a galosh wrapping machine (1) to implement said method are developed in order to prevent bacteria, microorganisms, dust, mud and other particles stuck under the shoes in natural circumstances, to be carried inside the premises where hygiene conditions are required. With said machine (1) the sole and the side walls (side vamps) of the footwear are wrapped with a film (21), warm air is blown at a suitable flow rate towards said sole and side vamps of the footwear, causing said film (21) to shrink and cover said sole and side vamps of the footwear by wrapping them up when it comes into contact with the film.

Figure 2:
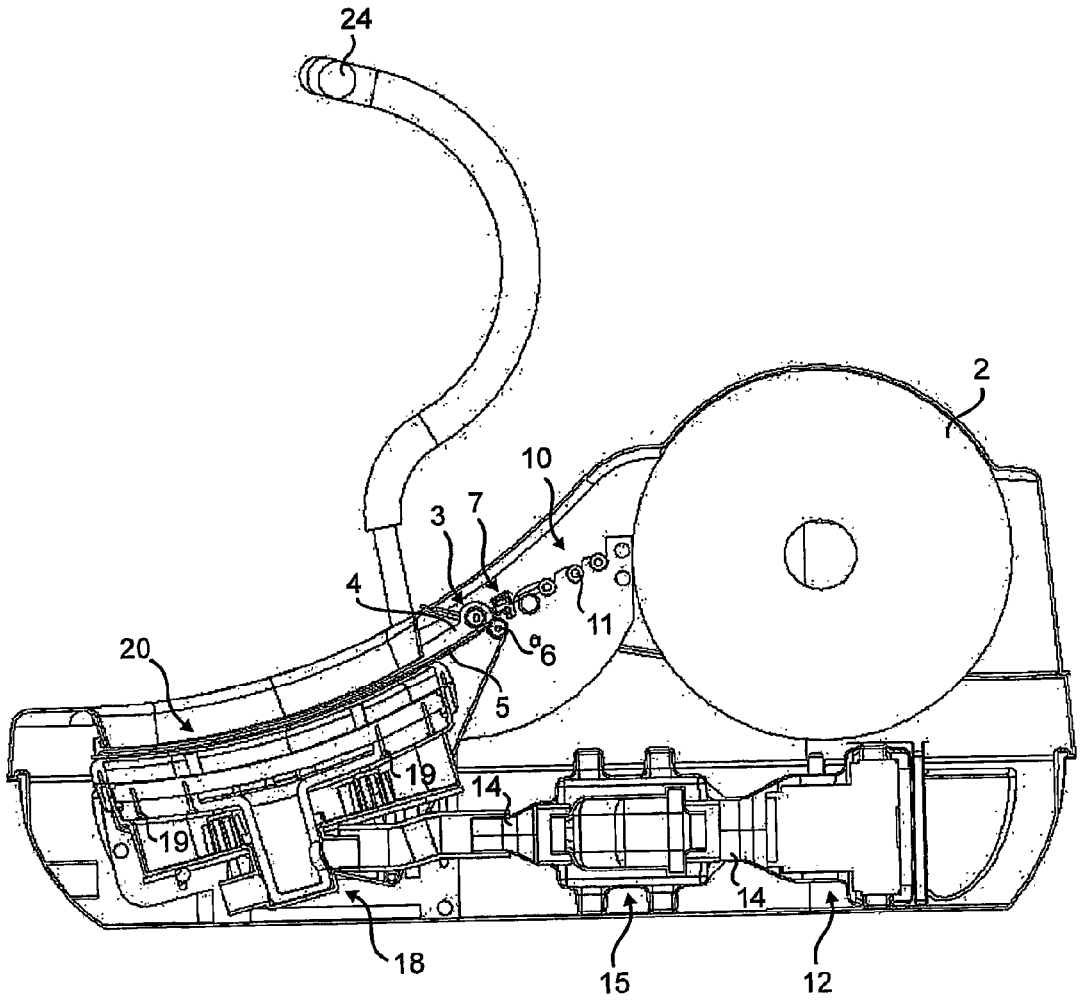
FIG. 2, is the side, cross-section view of the machine for wrapping a galosh around a footwear.

The machine for wrapping a galosh around a footwear comprises a spool recess (2) to contain the film spool on which the film material (21) to form a galosh is wound, a platform (20) on which the footwear sole is placed, a driver unit (3) to apply the film (21) onto the platform (20), a cutter unit (7) to cut the film (21) in appropriate dimensions, a spanner unit (10) to keep the film in a stretched form and to prevent it from (slipping) being released, an air blower unit (12) to take the ambient air into the machine (1), an air heater unit (15) to warm the air, and an air compression unit (18) that directs the warm air towards the film (21) (FIGS. 1 and 2).

The spool recess (2) wherein the film spool on which the film material (21) to form a galosh is wound, is located behind the machine (1). The free end of the film (21) wound on the spool, is inserted between the cylinders (11) forming the spanner unit (10) which is located next to the spool recess (2).

Said spanner unit (10) which serves to keep the film in a stretched form and to prevent it from (slipping) being released, consists of at least two opposing cylinders (11). In a preferred embodiment of the present invention, three cylinders (11) are placed side by side on the bottom surface with a certain distance provided between each other. The film (21) placed on these cylinders (11) are further stretched and its displacement is avoided by placing two more cylinders (11) on it in such a manner that they are fitted between the previously placed three cylinders. Barriers that surround the cylinder, of sufficient height to prevent the film (21) from escaping out of said cylinder (11), are formed around the cylinders (11) in order to prevent the film from slipping off the cylinders. The film (21) is placed between said barriers formed on said cylinders (11). Said cylinders (11) move mechanically on the machine (1) and rotate about their axes. The film (21) passing through the spanner unit (10), reaches the cutter unit (7), which is located after the spanner unit (10). The cutter unit (7) consists of a cutting motor (8) and a cutting apparatus which is formed by two opposingly located cutters (9) (blades). The length of said cutter blades is at least equal to the width of the film (21) to be cut.

When the cutting step is started, the two blades placed as opposing to each other with a film (21) between them, start to rotate about their axes and cut the film (21) by compressing it. In addition to this preferred cutting apparatus, in another embodiment, the film (21) is also cut by the movement of a blade which is of a length equal to the width of the film to be cut and which is placed above the film (21), in an orthogonal plane.

Figure 5:
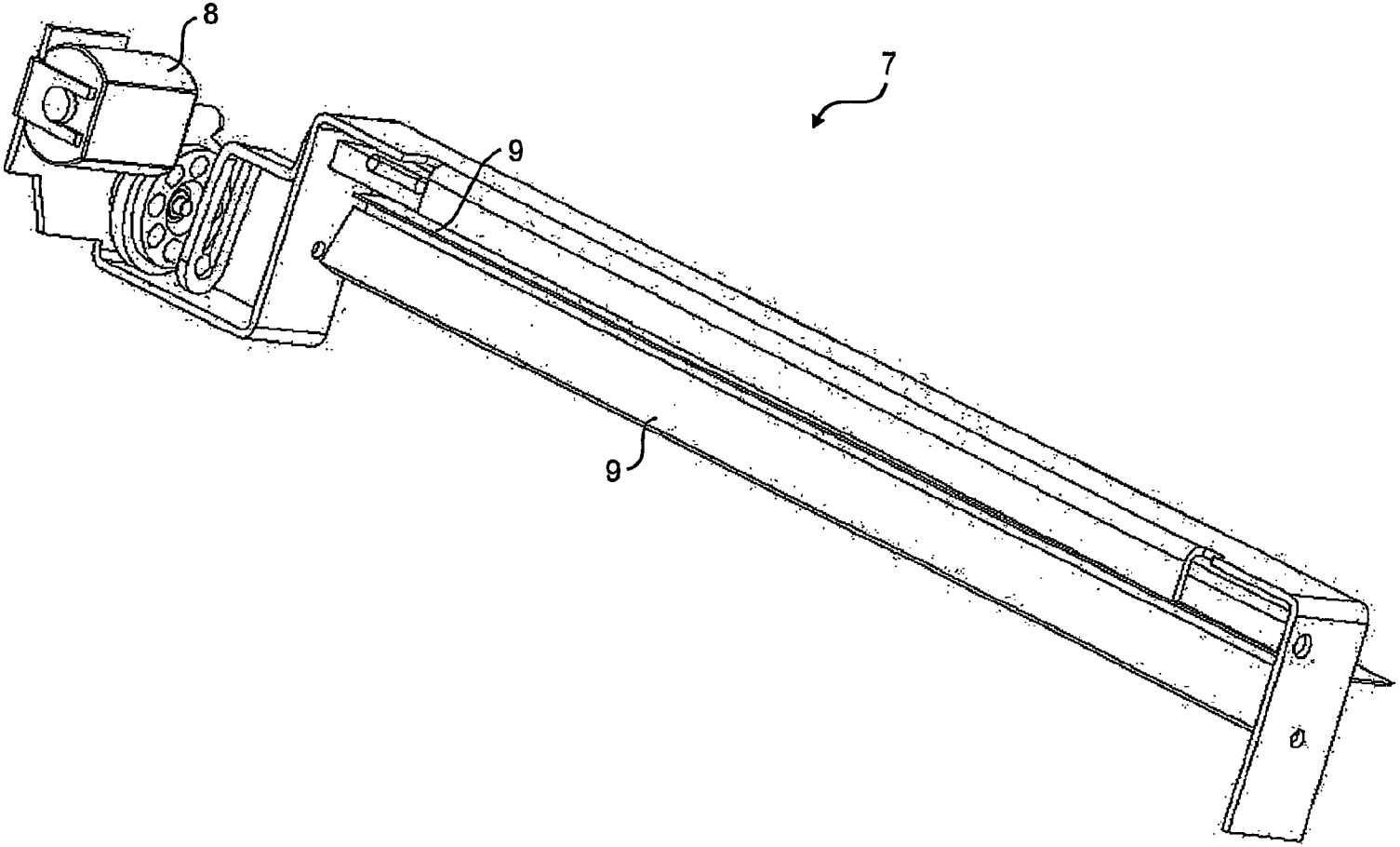
FIG. 5, is the perspective view of the cutter unit.

Although the dimensions of the film (21) cut by the cutting apparatus (7) are constant, they may be changed according to the dimensions of the footwear (FIG. 5).

The driver unit (3), placed just after the cutter unit (7) enables the film (21) to move in order to be released from the spool. Said movement of the film (21) is provided by the movement of two pallets (paddles) (5). Said pallets (5) consist of a rubber belt in a stretched position between two shafts (6) placed as opposing each other on the horizontal plane and rotated about their axes by a driver motor (6), in such a manner that it covers said two shafts (6). Said shafts (6) which are rotated by the motor (4), transfer this circular rotating movement made about their axes, to the pallet (5) so that said rotating movement is converted to a linear movement in order to enable said pallet (5) to move on a horizontal plane.

The two pallets (5) are arranged in a superposed position, i.e. one above the other and a gap is formed between the rubber belts constituting the pallet (5), through which at least the film (21) can be passed. The film (21) located between two pallets (5) is moved forwards by the clock wise rotation of the shafts (6) on the lower pallet (5) while the shafts (6) on the upper pallet (5) rotate in an anti-clock wise direction. The lower pallet (5) is slightly longer than the upper one, so that the slipping of the free end of the film (21) released from the spool, which is cut at the cutter unit (7) is avoided and said end is transferred to the driver unit.

In a preferred embodiment of the invention, electromagnetic clamps that hold the film (21) at both sides and which move on the guide rails, are located next to the pallets (5).

The film (21) progressing by virtue of the driver unit (3) arrives at the platform (20). When a pressure is applied onto the platform (20) it moves in line with the pressure applied on an orthogonal axis, and activates a switch circuit located under the platform in order to enable the operation of the machine (1).

Here, a sensor may be used instead of the switch circuit. Said platform (20) can easily be used, without regarding whether it is the right or left foot.

An air blower unit (12) is provided at the rear side of the machine (1) according to the invention, below the spool recess (2) or below the platform (20). Said blower unit (12) takes in the ambient air and blows it from below the platform (20) by means of the channels (19). The blower unit (12) consists of a motor (13) one end of which opens to the ambient air and the other end opens to the air tunnel (14) located in the machine (1).

Air, sucked in by means of said motor (1) is conveyed towards the inside of the machine (1) by means of said tunnel. One end of the tunnel opens to the blower unit (12) and the other end opens to the air heating unit (15). In case said blower unit (12) is placed under the platform (20), the air tunnels between the blower- (12), heater- (15) and compressor- (18) units are no more required.

Air, blown from the blower unit (12), reaches the air heater unit (15) by means of the tunnel. The heater unit (15) provides the heating of the hold air blown by the blower unit (12). This is made possible by means of the heaters (16) of various capacities, located in the heater unit. The energy required for the operation of the heaters (16) is supplied by a power source.

Figure 3:
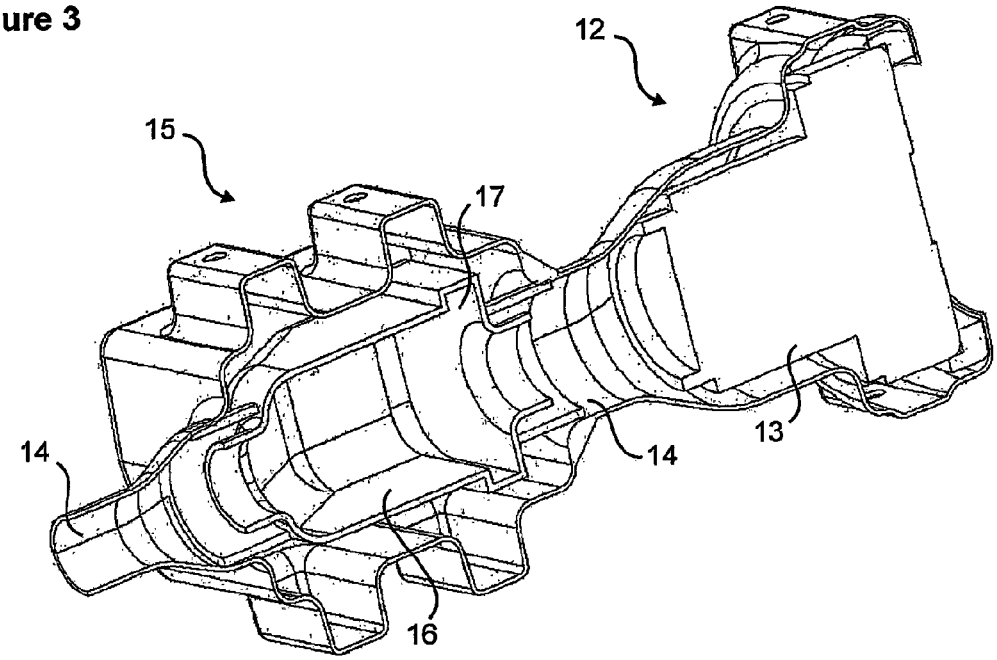
FIG. 3, is the perspective view of the air blower and heater unit.
Figure 4:
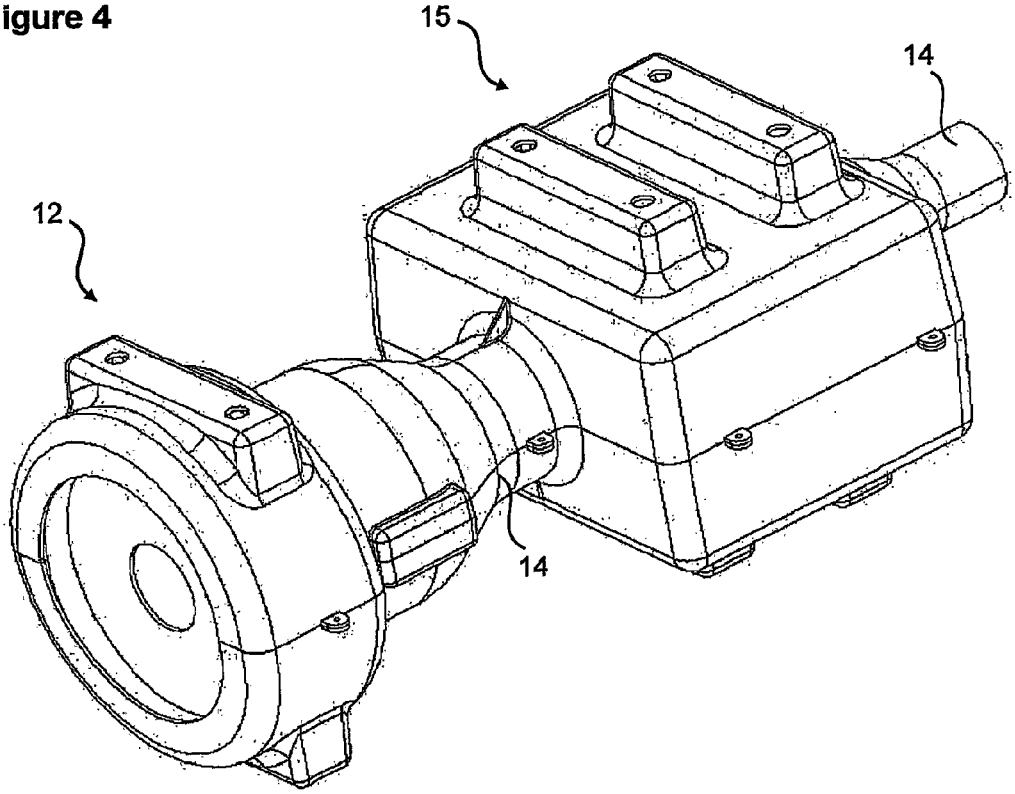
FIG. 4, is the side, cross-section view of the machine for wrapping a galosh around a footwear.

In the heater unit (15) temperature is controlled by means of the temperature controllers. In this manner the overheating of the heaters (16) are avoided and their operation while the machine (1) is not running, is prevented. Although, preferably a thermostat is used as a temperature controller (17), also the temperature sensors are considered to be within the scope of the present invention. The air compression unit (18) which enables the blowing of the air heated by the air heating unit (15), from the bottom of the platform (20), is connected to said heating unit (15) by means of an air tunnel (14) (FIG. 3 and FIG. 4).

Figure 6:
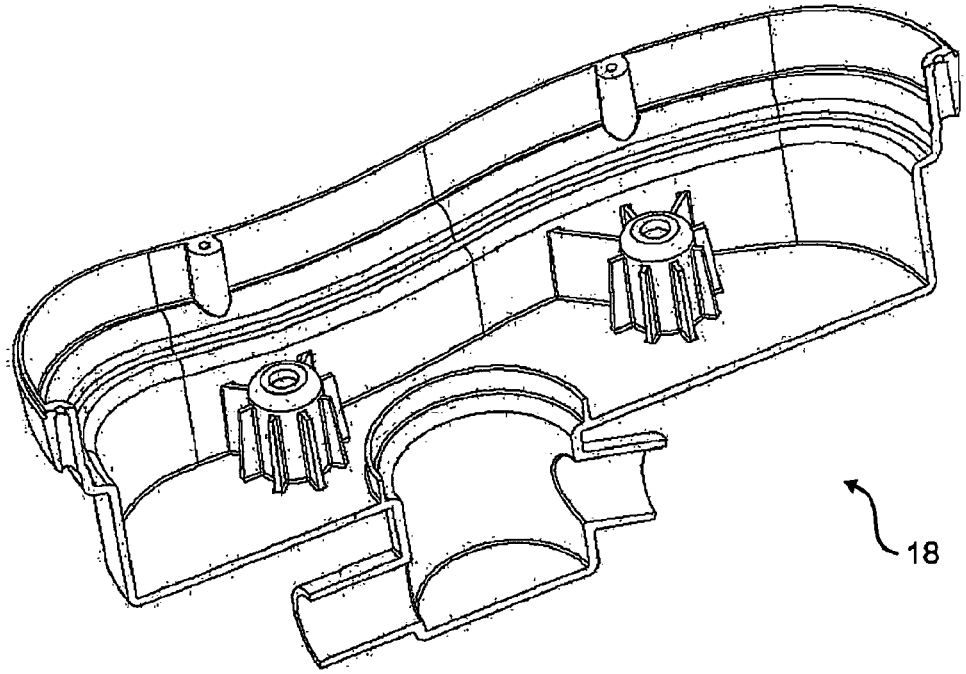
FIG. 6, is the side, cross-section of the air compression unit.
Figure 7:
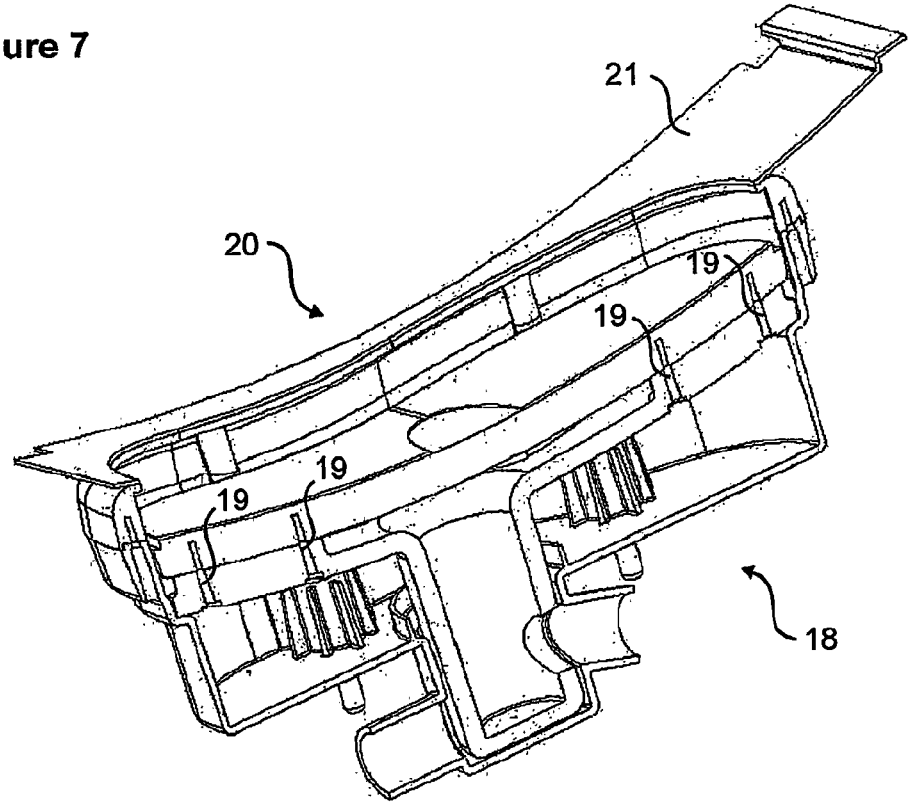
FIG. 7, is the side cross-section of the air compression unit and the platform.

The air compression unit (18) is located just below the platform (20) on which the sole of the footwear is placed. Air, heated at the air heating unit (15), reaches the air compression unit (18) by means of the air tunnel (14) and is blown from the bottom of the platform (20) towards the film (21) arranged on said platform (20) through the channels (19) located at the air compression unit (18) (FIG. 6 and FIG. 7).

All units described above, are placed between a lower-shell (22) and an upper-shell (23). Thereby, all units are protected against external impacts and any damages on the film (21) due to said impacts are avoided. Furthermore, the machine (1) has a compact and practical appearance.

In the machine (1) according to the invention, a handle (24) is provided on the platform (20) for the user to hold on. By using one or more platforms on the machine for wrapping a galosh around a footwear, galosher for both footwears worn on two feet may be wrapped at the same time.

A film (21) layer must be applied on the platform (20) before the footwear is placed on the platform (20). Therefore, the footwear is placed on a platform (20) on which said film is applied. Said platform (20) is lowered down in the direction of the pressure applied when the footwear is placed on it and said platform (20) activates a switch located just below it in order to enable the operation of the machine (1). At the same time, the motor provided at the air blower unit (12) starts to run in order to take the ambient air in and transfer it to the air tunnel (14) in the machine (1), air, passing through the air tunnel (14) reaches the air heater unit (15) wherein it is heated by the heaters (16) which, when operated, are heated and transfer their energy to the air molecules; then the air having a determined flow rate and temperature values, continues its way along the air tunnel (14), arrives at the air compression unit (18), wherein it passes through the channel (19), to be blown towards the film (21) arranged on the platform, so that the film having shrinkage characteristics when subjected to a determined flow rate and temperature values, shrinks by having its length and width dimensions reduced in such a manner that the film (21) is wrapped around the sole and side vamps of the footwear. As the temperature of the film (21) wrapped around the footwear and that of the ambient air, is colder than the temperature of the air blown, said film (21) remains on the footwear as if it were slipped on it. After a certain time, the user is warned by sound or visually, to draw back his footwear wrapped by a galosh. At the moment the user draws back his foot from the platform (20), the drive unit (3) is switched on, in order to provide the wrapping of another footwear by a galosh; the shafts (6) and pallets (5) located at the drive unit (3) start running in order to lead the film (21) provided between the pallets (5) to the platform (20) and when the film (21) having a determined length, comes to the top of the platform (20) the drive unit (3) stops and the cutting motor (8)

activates the cutter (9) to cut said film (21) at a certain length. In this case, the film (21) is placed on the platform (20) and is ready to wrap a footwear to be put on it. When a foot is placed on the platform (20) the same procedure is repeated, starting from first step, to wrap a galosh around a footwear.

A recycle box below which heaters (16) of various capacities are provided, is located next to the machine (1) according to the present invention.

The galoshes are disposed into said box after they are used, then they are melted by said heaters (16) and stored in this manner with reduces volumes; thereby they can be reused for the film (21) production, thus minimizing the formation of plastic debris in terms of environmental considerations.

The machine (1) according to the invention, makes it possible to take the film (21) material as a sheet from the spool and provides its shrinkage at the length and width dimensions, without any hand-contact, then by blowing air at a determined low rate and temperature on the film (21), it wraps the galosh around any kind of footwear.

The invention claimed is:

1. A machine (1) for wrapping a galosh around a footwear, comprising: a foot platform (20) to place the footwear on; a spool recess (2) wherein a film spool on which a film (21) used to form the galosh to be wrapped around the footwear is wound, is placed; a spanner unit (10) to keep the film (21) released from the spool in a stretched form and to avoid its being uncontrollably released, which including at least two pivoting cylinders (11) placed as opposing each other, move mechanically by the movement of said film (21); a cutting unit (7) including a cutting motor (8), and one or more cutters (9), driven by said motor (8), which cuts the film (21) by the pivoting movement of said cutters (9); a drive unit (3) including a rubber belt stretched between two pivoting shafts (6), placed on a horizontal plane as opposing each other and driven by driver motor (4), which enables the film (21) to move and to be released from the spool, and also including two pallets (5) placed in a superposed manner, which convert the circular pivoting rotations of said two shafts (6) to linear movements; an air blower unit (12), one end of which opens to the environment and the other end, to the inner space of the machine (1), including a motor (13), that takes in ambient air; an air heater unit (15) to heat the cold air blown by blower unit (12) by use of the heaters (16); an air compression unit (18) which directs the air heated in the air heater unit (15) to be blown towards the film (21) provided on the platform (20) by use of channels (19).

2. The machine (1) for wrapping a galosh around a footwear as defined in claim 1, wherein the spanner unit (10) comprises three cylinders (11) placed side by side on a bottom surface with a certain distance provided between each other whereby the film (21) placed on these cylinders (11) are further stretched and its displacement is avoided by placing two more cylinders (11) on it in such a manner that they are fitted between the previously placed three cylinders.

3. The machine (1) for wrapping a galosh around a footwear as defined in claim 2, wherein the spanner unit (10) comprises barriers that surround the cylinder, of a sufficient height to prevent the film (21) from escaping out of said cylinder (11), are formed around the cylinders (11) in order to prevent the film from slipping off the cylinders.

4. The machine (1) for wrapping a galosh around a footwear as defined in claim 1, wherein the cutting unit (7) comprises a cutting motor (8), and one or more cutters (9), driven by said motor (8), which cuts the film (21) by the pivoting movement of said cutters (9) placed opposingly with the film (21) sandwiched between them, which compress the film (21) by pivoting.

5. The machine (1) for wrapping a galosh around a footwear as defined in claim 4, wherein the cutting unit (7), comprises a cutter (9) which makes it possible to keep constant the length of the film (21) cut off.

6. The machine (1) for wrapping a galosh around a footwear as defined in claim 4, wherein the cutting unit (7), comprises a cutter (9) which makes it possible to have varying lengths of the film (21) cut, according to the length of the footwear.

7. The machine (1) for wrapping a galosh around a footwear as defined in claim 1, wherein the cutting unit (7) comprising a cutter (9) which is placed above the film (21) and cuts it when activated by a motor to move in a vertical plane.

8. The machine (1) for wrapping a galosh around a footwear as defined in claim 4, wherein the cutting unit (7) comprises a cutter (9) of a length which is at least equal to the width of the film (21).

9. The machine (1) for wrapping a galosh around a footwear as defined in claim 1, wherein the drive unit (3) wherein the film (21) located between two pallets (5) is moved forwards by the clockwise rotation of the shafts (6) on the lower pallet (5) while the shafts (6) on the upper pallet (5) rotate in an anti-clock wise direction.

10. The machine (1) for wrapping a galosh around a footwear as defined in claim 9, wherein the drive unit (3) comprises a pallet (5) located as apposing the upper pallet (5) and which is longer than the upper pallet (5) so that the film end on the spool which is cut at the cutting unit (7) and left free, is prevented from slipping off.

11. The machine (1) for wrapping a galosh around a footwear as defined in claim 9, wherein the drive unit (3) wherein the pallets (5) comprise rubber belts between two of which a gap is formed and at least one film (21) can pass through said gap.

12. The machine (1) for wrapping a galosh around a footwear as defined in claim 9, wherein the drive unit (3), wherein the electromagnetic clamps that hold the film (21) at both sides and which move on the guide rails, located next to the pallets (5).

13. The machine (1) for wrapping a galosh around a footwear as defined in claim 1, wherein the air blower unit (12) comprises at least one motor (13) to take the ambient air into the machine (1).

14. The machine (1) for wrapping a galosh around a footwear as defined in claim 13, wherein the air blower unit (12) including at least one motor (13) one end of which opens to the ambient air and the other end opens to an air tunnel (14).

15. The machine (1) for wrapping a galosh around a footwear as defined in claim 13, wherein the air blower unit (12) one end of which opens to the ambient air and the other end opens to the air heating unit (15).

16. The machine (1) for wrapping a galosh around a footwear as defined in claim 1, wherein the air heating unit (15) comprising at least one temperature controller that keeps the blown air within a temperature range.

17. The machine (1) for wrapping a galosh around a footwear as defined in claim 16, wherein a thermostat used as a temperature controller (17).

18. The machine (1) for wrapping a galosh around a footwear as defined in claim 16, wherein a temperature sensor used as a temperature controller (17).

19. The machine (1) for wrapping a galosh around a footwear as defined in claim 1, wherein the air compressor unit (18) is located just below the platform (20) on the sole of the footwear is placed.

20. The machine (1) for wrapping a galosh around a footwear as defined in claim 19, wherein the air compressor unit (18) is connected to the air heating unit (15) through an air tunnel (14).

21. The machine (1) for wrapping a galosh around a footwear as defined in claim 19, wherein the air compressor unit (18) is directly connected to the air heating unit (15).

22. The machine (1) for wrapping a galosh around a footwear as defined in claim 19 are, wherein the channels (19) located between the air compressor unit (19) and the platform (20).

23. The machine (1) for wrapping a galosh around a footwear as defined in claim 22, wherein said channels (19) have rectangular sections.

24. The machine (1) for wrapping a galosh around a footwear as defined in claim 22, wherein said channels (19) have curvilinear sections.

25. The machine (1) for wrapping a galosh around a footwear as defined in claim 1, wherein a recycle box below which heaters (16) of various capacities are provided, and wherein the galoshes are disposed and collected after being used.

26. The machine (1) for wrapping a galosh around a footwear as defined in claim 1, wherein a handle (24) is provided on the platform (20) for the user to hold on.

27. The machine (1) for wrapping a galosh around a footwear as defined in claim 1, wherein one or more platforms (20) are provided on which the footwear is placed.

* * * * *